US008371834B2

(12) United States Patent
Hwang

(10) Patent No.: US 8,371,834 B2
(45) Date of Patent: Feb. 12, 2013

(54) ANTI-SELF ROTATION MECHANISM OF A SCROLL FLUID MACHINE

(75) Inventor: Booseok Hwang, Tokyo (JP)

(73) Assignees: RichStone Limited, Tokyo (JP); RichStone Limited, Jeonju (KR)

( * ) Notice: Subject to any disclaimer, the term of this patent is extended or adjusted under 35 U.S.C. 154(b) by 925 days.

(21) Appl. No.: 12/457,134

(22) Filed: Jun. 2, 2009

(65) Prior Publication Data

US 2009/0297381 A1 Dec. 3, 2009

(30) Foreign Application Priority Data

Jun. 3, 2008 (JP) ..... 2008-145607

(51) Int. Cl.

| | |
|---|---|
| ***F01C 1/02*** | (2006.01) |
| ***F01C 1/063*** | (2006.01) |
| ***F04C 2/02*** | (2006.01) |
| ***F04C 2/063*** | (2006.01) |
| ***F04C 18/02*** | (2006.01) |
| ***F04C 18/063*** | (2006.01) |

(52) U.S. Cl. ..... 418/55.3; 418/55.1; 418/55.6; 418/91; 418/94; 418/98; 464/105

(58) Field of Classification Search ..... 418/55.3, 418/55.1, 55.6, 91, 94, 98; 464/105
See application file for complete search history.

(56) References Cited

U.S. PATENT DOCUMENTS

| | | | | |
|---|---|---|---|---|
| 3,789,627 | A * | 2/1974 | Smith | 464/105 |
| 5,395,220 | A * | 3/1995 | Miura et al. | 418/55.3 |
| 2001/0033801 | A1 * | 10/2001 | Takahashi | 418/55.3 |

FOREIGN PATENT DOCUMENTS

| | | |
|---|---|---|
| JP | 2001-304143 | 10/2001 |
| JP | 3540244 | 7/2004 |

* cited by examiner

*Primary Examiner* — Mary A Davis

(57) ABSTRACT

An anti-self rotation mechanism for preventing self-rotation of the eccentric shaft includes a long orbiting key formed at an end of the eccentric shaft, a ring formed of a long hole through which the orbiting key slides, ring keys that extend toward both outer sides in the direction orthogonal to the longitudinal direction of the hole, and two key grooves formed in the casing, through which the ring keys slide.

13 Claims, 7 Drawing Sheets

ANTI-SELF ROTATION MECHANISM OF A SCROLL FLUID MACHINE

PRIORITY

This application claims priority to Japanese Patent Application JP2008-145607, filed Jun. 3, 2008, which is incorporated by reference herein, in its entirety.

BACKGROUND OF THE INVENTION

1. Field of the Invention

The invention relates to a scroll fluid machine such as an air compressor, a vacuum pump, a refrigerant gas compressor, a compressor for an oxygen inhaler, and an expander for energy collection and temperature difference power generation.

2. Description of the Related Art

The scroll fluid machine as disclosed in Japanese Patent No. 3540244 includes an eccentric shaft inserted into an eccentric hole formed in a rotary shaft to penetrate therethrough via a bearing, and an anti-self rotation mechanism for preventing self-rotation of the eccentric shaft. The anti-self rotation mechanism for the eccentric shaft includes a frame-like support member fixed to a casing, and a movable plate slidably supported on the support member, which has a long hole along a longitudinal direction orthogonal to the sliding direction. Cutout surfaces are formed at both ends of the eccentric shaft so as to be engaged with the longitudinal surface of the hole.

It is difficult for the aforementioned related art to reduce the width of the movable plate in the direction orthogonal to the sliding direction, and further to increase the length in the same direction as the sliding direction. In other words, it is difficult to increase the length of the movable plate, and accordingly, the large key load resulting from the self-rotational torque is likely to cause galling and wear of the sliding portion. As it is difficult to reduce the width of the movable plate, imbalance between the left and right sliding resistance values may cause the moment to rotate the movable plate. It is difficult for the movable plate to smoothly slide, resulting in unsteady sliding operation. It is difficult to increase the length of the cutout surface at the end of the eccentric shaft in the sliding direction, which makes the key load resulting from the self-rotational torque excessive, resulting in galling and wear. As the rotating angle defined by the gap between the key and the key groove becomes large, it is difficult to accurately maintain the wrap phase between the fixed scroll and the orbiting scroll. This may cause the noise and galling owing to the wrap contact, resulting in deteriorated performance.

SUMMARY OF THE INVENTION

Accordingly, it is an object of the invention to provide a scroll fluid machine for reducing the sliding loss of the component of the anti-self rotation mechanism for the eccentric shaft to suppress the wear, damage, and sliding noise.

A scroll fluid machine according to the invention includes an eccentric drive mechanism including a casing, a rotary shaft rotatably provided inside the casing and including an eccentric hole formed to penetrate the rotary shaft to have an axis in parallel with an axis of the rotary shaft, an eccentric shaft disposed through the eccentric hole via a bearing which has the eccentric shaft orbited by rotating the rotary shaft. An anti-self rotation mechanism is formed for preventing an self-rotation of the eccentric shaft, and includes a long orbiting key formed at an end of the eccentric shaft, a ring including a long hole through which the orbiting key slides, and ring keys which extend toward both outer sides in a direction orthogonal to a longitudinal direction of the hole, and two key grooves formed in the casing, through which the ring keys slide.

In the scroll fluid machine, the orbiting key further includes two end portions partially formed as sliding surfaces, and an intermediate portion between the end portions has a width smaller than each width of the end portions.

In the scroll fluid machine, each of the end portions has a thickness larger than a thickness of another portion of the ring key so as to be in contact with each bottom of the key grooves.

The scroll fluid machine further includes an orbiting plate between an end of the eccentric shaft and the orbiting key. A surface of the orbiting plate at a side of the ring is in contact with a surface of the ring at a side of the orbiting plate.

In the scroll fluid machine, the orbiting plate is brought into partial surface contact with the ring by forming a non-contact portion of at least one of the orbiting plate and the ring into a recess portion.

In the scroll fluid machine, the DLC coating is applied to a sliding portion of at least one of the orbiting key, a periphery of the hole, the ring key, and the key groove.

In the scroll fluid machine, an oil receiving port is formed on an upper surface of the orbiting key. An oil passage in communication with the oil receiving port is formed inside the eccentric shaft. A horizontal hole for supplying oil is formed extending from the oil passage to the bearing.

The scroll fluid machine according to the invention is capable of suppressing the wear, damage and sliding noise by reducing the sliding loss of the component of the anti-self rotation mechanism for the eccentric shaft.

DESCRIPTION OF THE PREFERRED EMBODIMENTS

First Embodiment

Figure 1:
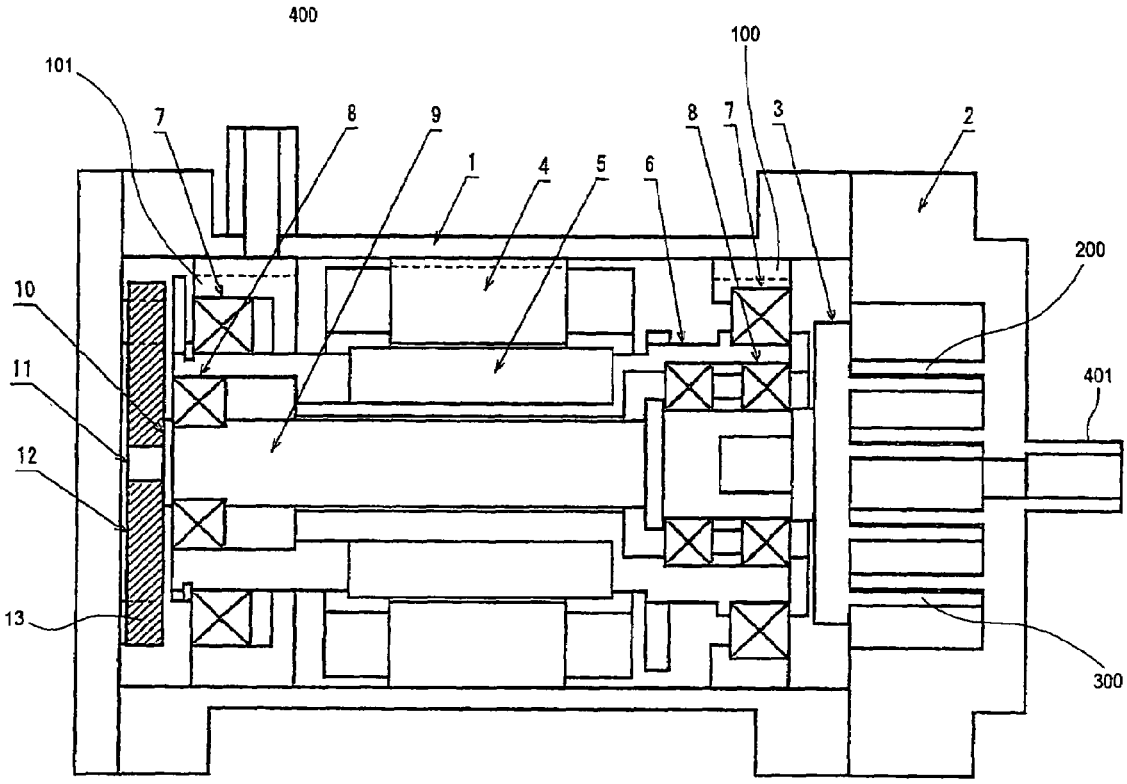
FIG. 1 is a schematic sectional view showing a scroll fluid machine according to a first embodiment.

FIG. 1 is a schematic sectional view showing a scroll fluid machine according to a first embodiment of the invention. A fixed scroll 2 provided with a spiral wrap 200 is fixed to a casing 1. A stator 4 and bearing supports 100, 101 are fixed to the casing 1. A rotary shaft 6 is rotatably supported on the bearing supports 100, 101 via bearings 7. A rotor 5 is fixed to the rotary shaft 6. A motor is formed of the stator 4, the rotor 5 and the like. An eccentric hole having the axis in parallel with that of the rotary shaft 6 is formed to penetrate therethrough. An eccentric shaft (orbiting shaft) 9 is rotatably supported in the eccentric hole of the rotary shaft 6 via bearings 8. The center line of the rotary shaft 6 deviates from that of the eccentric shaft 9. That is, the eccentric shaft 9 is rotatably supported eccentrically with respect to the rotary shaft 6. An orbiting scroll 3 is attached to one end of the eccentric shaft 9. A wrap 300 with the same shape as that of the wrap 200 of the fixed scroll 2 is attached to the orbiting scroll 3. The wrap 300 of the orbiting scroll 3 is overlapped with the wrap 200 of the fixed scroll 2 to define plural compression chambers. The main body of the compressor is formed of the fixed scroll 2, the orbiting scroll 3, and the like.

An intake pipe 400 is connected to the casing 1, and a discharge pipe 401 is connected to the fixed scroll 2. The intake pipe 400 and the discharge pipe 401 are communicated with the compression chamber. The casing 1, the motor, the rotary shaft 6, the eccentric shaft 9, and the anti-self rotation mechanism constitute an eccentric orbiting drive unit.

In the scroll fluid machine, electricity applied to a winding of the stator 4 rotates the rotor 5 and the rotary shaft 6 such that the eccentric shaft 9 eccentrically orbits around the center line of the rotary shaft 6. The eccentric shaft 9 is prevented from self rotating by the anti-self rotation mechanism to be described later. The eccentric shaft 9 and the orbiting scroll 3 eccentrically orbit with respect to the casing 1 and the fixed scroll 2 without rotating, respectively. The compression chamber defined by the orbiting scroll 3 and the fixed scroll 2 has its size gradually reduced. The gas to be compressed, for example, air is sucked from the intake pipe 400, compressed in the compression chamber, and discharged from the discharge pipe 401.

The anti-self rotation mechanism for preventing the self-rotation of the eccentric shaft 9 will be described hereinafter.

Figure 2A:
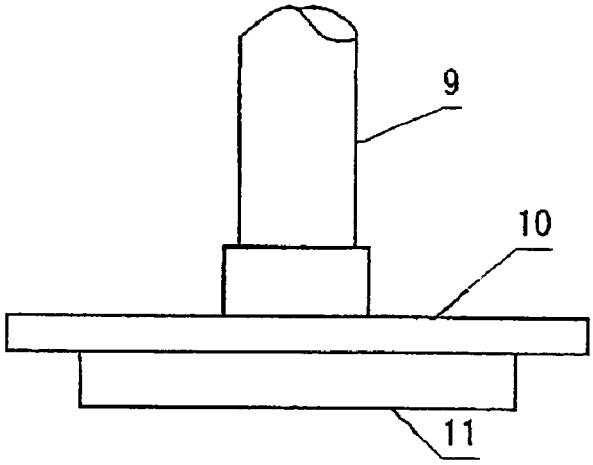
FIG. 2A is a front view.
Figure 2B:
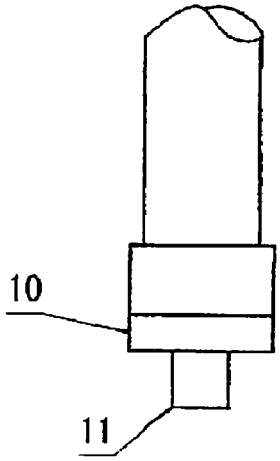
FIG. 2B is a side view and FIG. 2C is a bottom view of an orbiting key 1 according to the first embodiment.
Figure 2C:
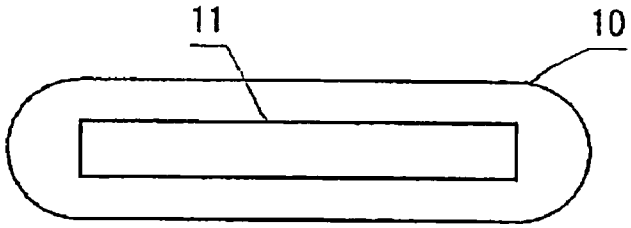
Figure 3A:
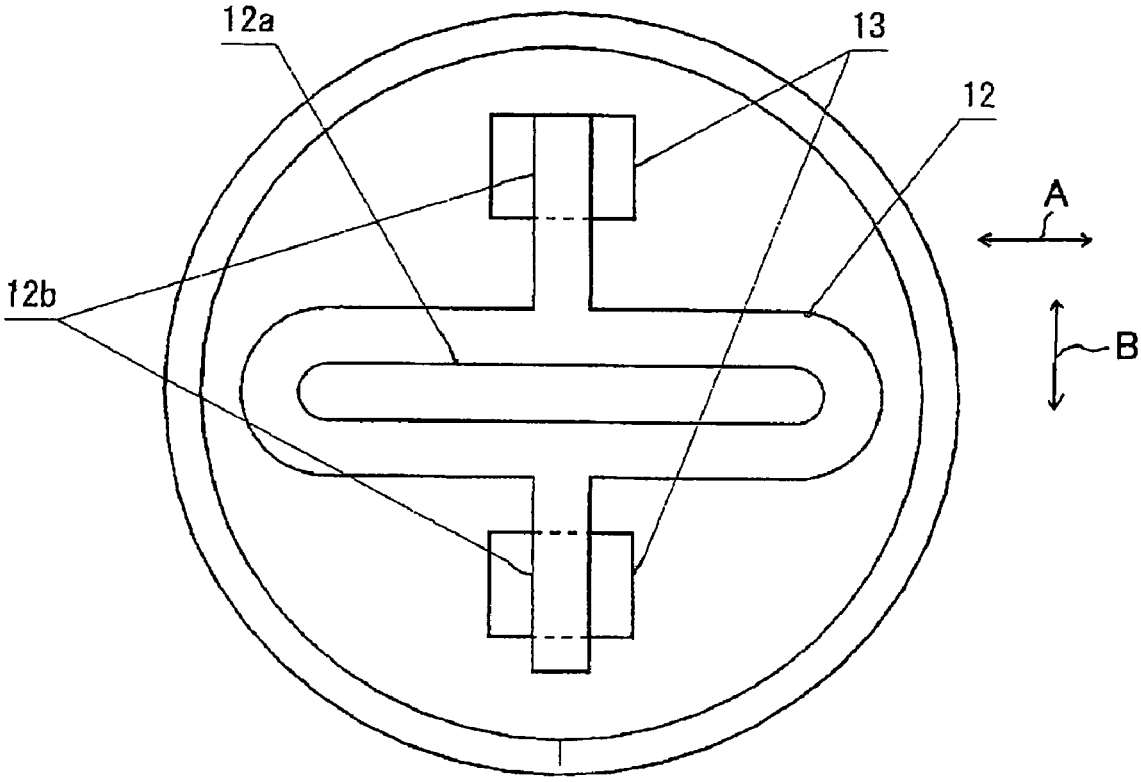
FIG. 3A is a top view and FIG. 3B is a front view of a ring 12 and key grooves 13 according to the first embodiment.
Figure 3B:
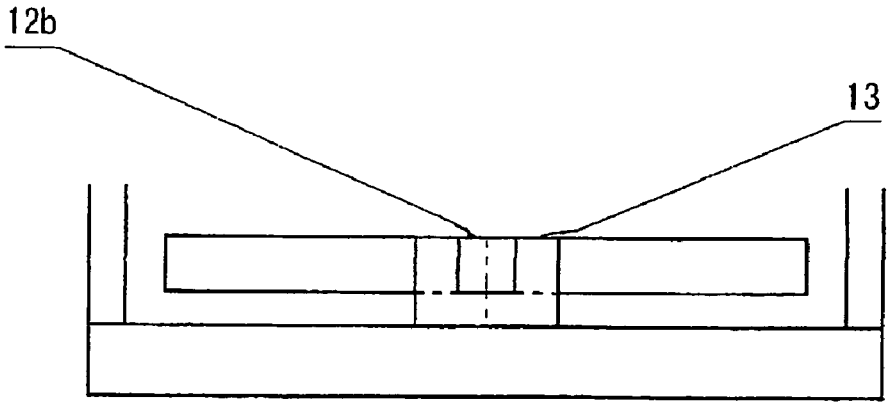

FIG. 2 shows an orbiting key 11, and specifically, FIG. 2A is a front view, FIG. 2B is a side view, and FIG. 2C is a bottom view. FIG. 3 shows a ring 12 and key grooves 13, and specifically, FIG. 3A is a plan view, and FIG. 3B is a front view.

Referring to FIGS. 1 and 2, an orbiting plate 10 is fixed to an end of the eccentric shaft 9, that is, the left side of FIG. 1. The long orbiting key 11 is formed on a bottom surface of the orbiting plate 10. The ring 12 for preventing self-rotation of the eccentric shaft 9 includes a long hole 12*a*, and ring keys 12*b*. The orbiting key 11 is engaged with the long hole 12*a* to be slidable along a direction A (FIG. 3) (The "hole" includes a non-penetrating groove). The ring keys 12*b* extend toward both outer sides in the direction orthogonal to the longitudinal direction of the hole 12*a*. The key grooves 13 (specifically, a member with the key groove) are formed in the casing 1. The key grooves 13 are engaged with ring keys 12*b* to allow the ring 12 to slide along a direction B.

In the invention, the anti-self rotation mechanism for preventing the self-rotation of the eccentric shaft 9 includes the long orbiting key 11 (FIG. 2) formed at the end of the eccentric shaft 9, the ring 12 (FIG. 3) formed of the long hole 12*a* and the ring keys 12*b*, and two key grooves 13 to allow the ring key 12*b* to slide therethrough. The orbiting plate 10 is provided between the end of the eccentric shaft 9 and the orbiting key 11. The surface of the orbiting plate 10 at the side of the ring 12 is brought into contact with the surface of the ring 12 at the side of the orbiting plate 10 so as to be slidable.

The above structure allows the orbiting key 11 to slide with respect to the ring 12 while being prevented from rotating, and the ring 12 to slide with respect to the casing 1 while being prevented from rotating. The eccentric shaft 9 may be orbited while being prevented from self-rotating.

In the embodiment, the long orbiting key 11 with the predetermined length is formed at the end of the eccentric shaft 9 to reduce the load to the orbiting key 11 which bears the self-rotational torque. This makes it possible to reduce the sliding loss, and suppress wear and damage of the orbiting key 11 and the key grooves 13, and the sliding noise. The embodiment is capable of solving the problem of the related art as described above.

A non-contact portion of at least one of the orbiting plate 10 and the ring 12 may be formed into a recess portion such that the orbiting plate 10 and the ring 12 are in partially surface contact with each other (not shown). This may reduce the sliding loss, and suppress the wear and damage of the orbiting plate 10 and the ring 12 and the sliding noise.

A DLC (diamond-like carbon) coating may be applied to the sliding portion of at least one of the orbiting key 11, the hole 12*a* and the ring key 12*b* of the ring 12, and the key grooves 13. This may prevent the wear and damage of the sliding portion of the anti-self rotation mechanism in the scroll fluid machine of the type requiring no lubricant, thus ensuring reliability and durability.

Second Embodiment

Figure 4A:
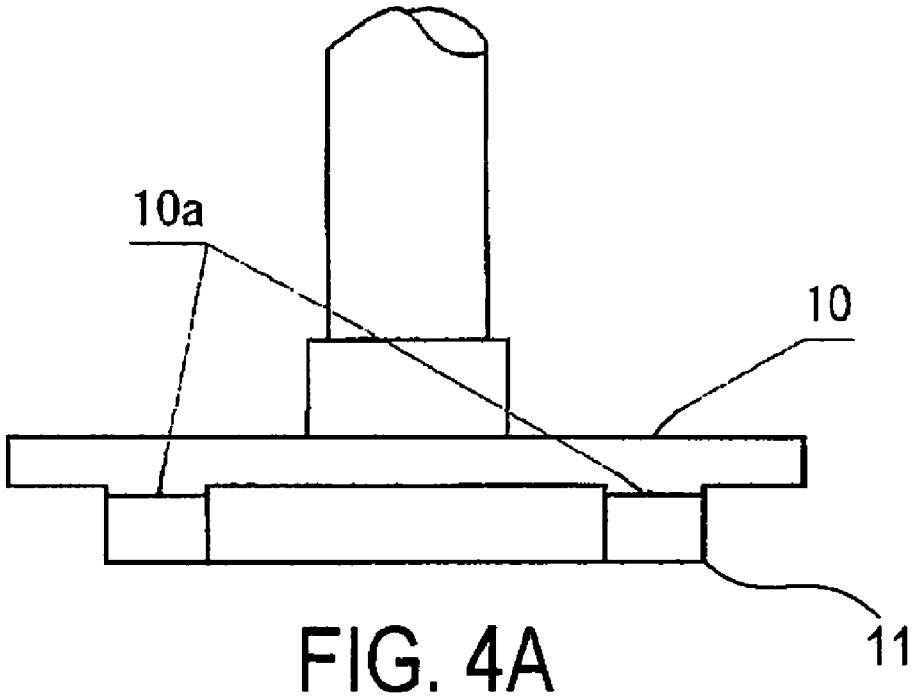
FIG. 4A is a front view and FIG. 4B is a bottom view of an orbiting key 11 according to a second embodiment.
Figure 4B:
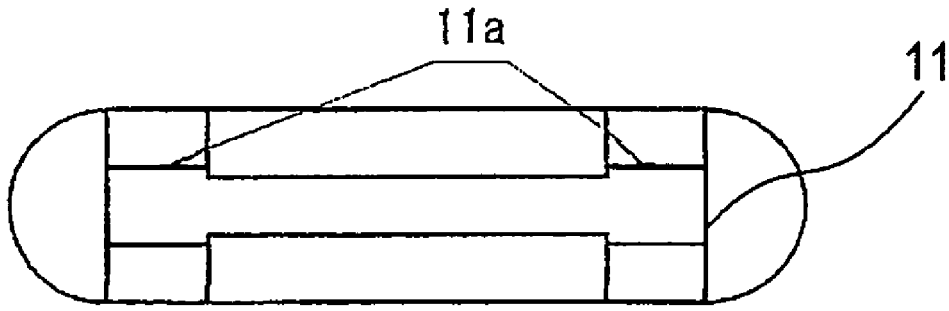

FIG. 4 shows an orbiting key 11 whose structure is different from that of the first embodiment. FIG. 4A is a front view and FIG. 4B is a bottom view.

In the embodiment, both end portions 11*a* of the orbiting key 11 are formed as sliding surfaces. The width of the intermediate portion of the orbiting key 11 is smaller than each width of both end portions. The portion with the reduced width bears no load. The gap between such portion and the long hole 12*a* of the ring 12 serves to hold the lubricant. Each thickness of both end portions 11*a* of the orbiting key 11 (not shown) may be increased to be formed as the sliding surface. The intermediate portion of the orbiting key 11 may be made thinner than both end portions.

The surface of the orbiting plate 10 at the side of the ring 12 is brought into contact with the surface of the ring 12 at the side of the orbiting plate 10. Referring to FIG. 4A, only the end portions 11*a* of the orbiting key 11 corresponding to the portions 10*a* of the orbiting plate 10 laterally extend (width direction) so as to be in contact with the hole 12*a* (see FIG. 3). This may eliminate the unnecessary contact, thus suppressing the sliding loss and the sliding noise.

Third Embodiment

Figure 5A:
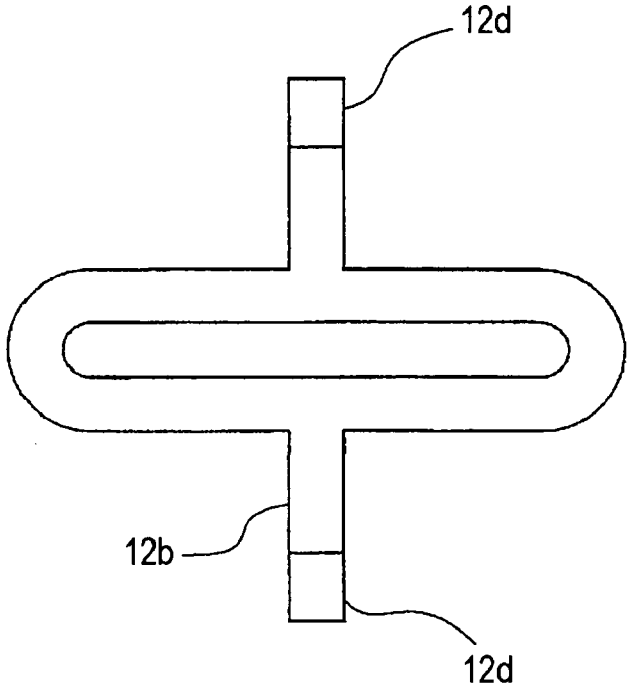
FIG. 5A is a bottom view and FIG. 5B is a side view of a ring 12 according to a third embodiment.
Figure 5B:
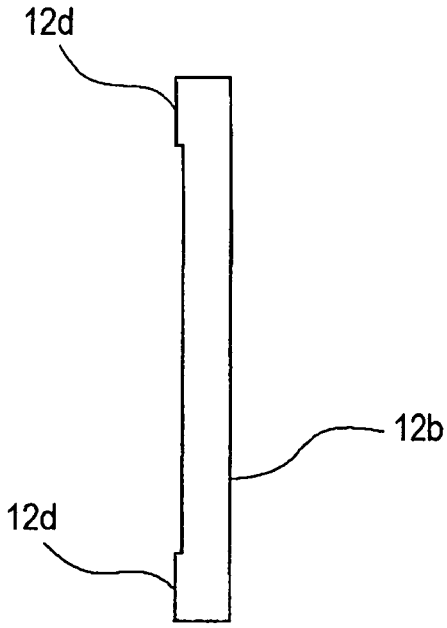

FIG. 5 shows a ring 12 whose ring key 12*b* has different structure from that of the first embodiment. FIG. 5A is a front view and FIG. 5B is a side view.

In the embodiment, both end portions 12*d* of the ring key 12*b* of the ring 12 are made thicker so as to be in contact with the bottom of the key groove 13 as shown in FIG. 5. The other portion of the ring key 12*b* has the smaller thickness. The structure may suppress the sliding loss and the sliding noise compared with the case where the entire bottom surface of the ring key 12*b* is in contact with the bottom of the key groove 13.

Fourth Embodiment

Figure 6:
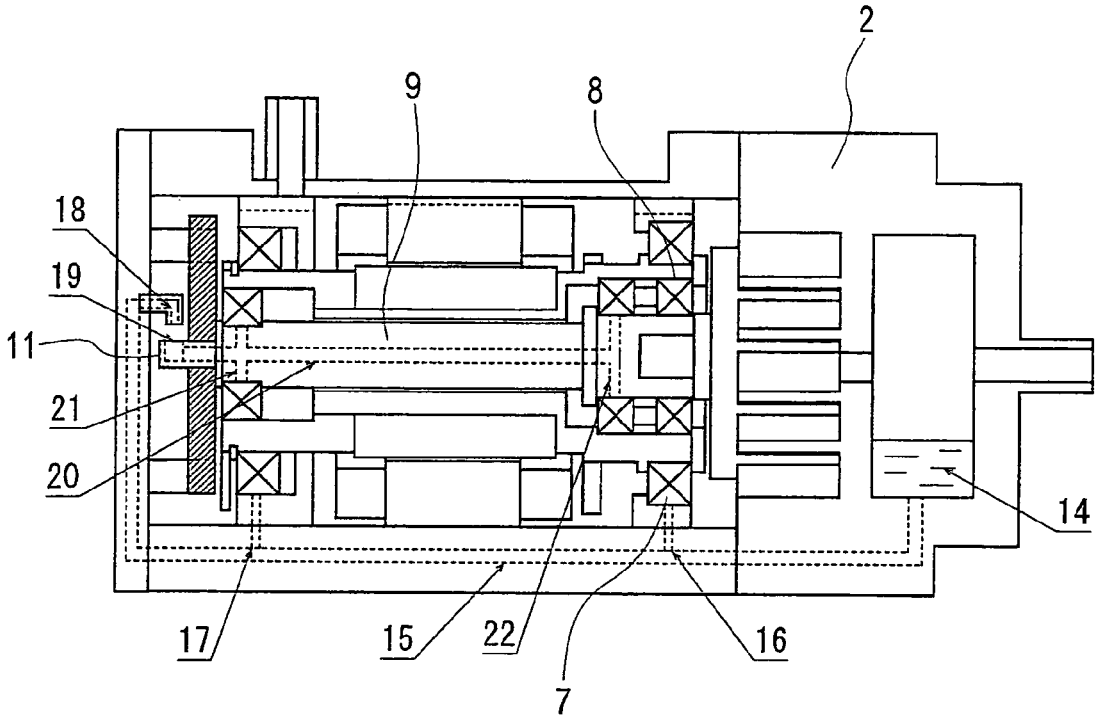
FIG. 6 is a schematic sectional view showing a scroll fluid machine according to a fourth embodiment.
Figure 7A:
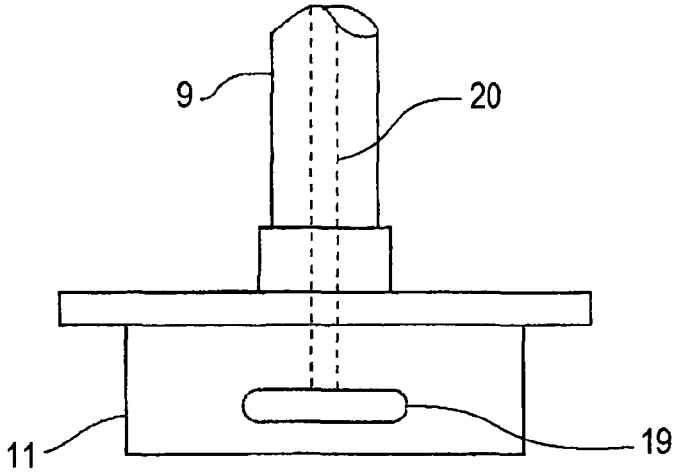
FIG. 7A is a front view.
Figure 7B:
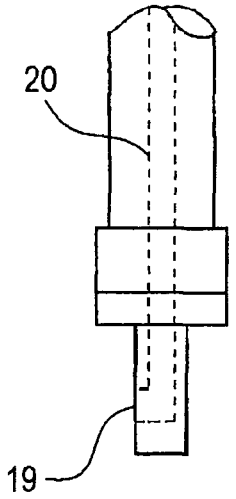
FIG. 7B is a side view.
Figure 7C:
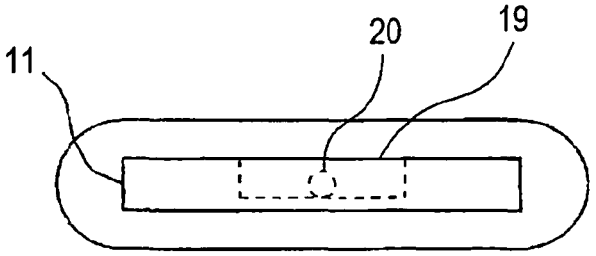
FIG. 7C is a bottom view of an orbiting key 11 according to the fourth embodiment.

FIG. 6 is a schematic sectional view showing the scroll fluid machine which is different from the first embodiment as shown in FIG. 1. FIGS. 7A to 7C are front view, side view, and bottom view of the orbiting key 11.

An oil reservoir 14 is formed inside the fixed scroll 2 as shown in FIG. 6 (The oil reservoir 14 is communicated with the discharge chamber in the compressor, and with the intake chamber in the expander). The oil is supplied from the oil reservoir 14 to an oil supply passage 15 under the differential pressure, and further to the bearings 7 through oil feeding holes 16, 17. An oil supply port 18 communicated with the oil supply passage 15 is formed. Referring to FIGS. 6 and 7, an oil receiving port 19 is formed on the upper surface of the orbiting key 11 directed upward as shown in FIG. 6. The oil receiving port 19 is located below the oil supply port 18, and an oil passage 20 communicated with the oil receiving port 19 is formed inside the eccentric shaft 9. A horizontal hole 22 is formed to extend from the oil passage 20 to the bearing 8 for oil supply. The above structure allows all the bearings 7 and 8 to receive the oil supply, thus improving reliability and durability of the scroll fluid machine.

What is claimed is:

1. A scroll fluid machine comprising:

an eccentric drive mechanism including a casing;

a rotary shaft rotatably provided inside the casing and including an eccentric hole formed to penetrate the rotary shaft to have an axis in parallel with an axis of the rotary shaft;

a bearing;

an eccentric shaft disposed through the eccentric hole via the bearing so that the eccentric shaft is orbited by rotating the rotary shaft; and an anti-self rotation mechanism for preventing a self-rotation of the eccentric shaft, the anti-self rotation mechanism including a long orbiting key, whose length is longer than a diameter of the eccentric shaft, formed at an end of the eccentric shaft, a ring including a long hole through which the orbiting key slides, and ring keys which extend toward both outer sides in a direction orthogonal to a longitudinal direction of the hole, and two key grooves formed in the casing, through which the ring keys slide.

2. The scroll fluid machine according to claim 1, wherein:

the orbiting key further includes two end portions partially formed as sliding surfaces; and an intermediate portion between the end portions has a width smaller than each width of the end portions.

3. The scroll fluid machine according to claim 2, wherein:

an oil receiving port is formed on an upper surface of the orbiting key;

an oil passage in communication with the oil receiving port is formed inside the eccentric shaft; and a horizontal hole for supplying oil is formed extending from the oil passage to the bearing.

4. The scroll fluid machine according to claim 1, wherein the ring key includes two end portions, each of the end portions has a thickness larger than a thickness of the other portion so as to be in contact with each bottom of the key grooves.

5. The scroll fluid machine according to claim 4, wherein:

an oil receiving port is formed on an upper surface of the orbiting key;

an oil passage in communication with the oil receiving port is formed inside the eccentric shaft; and a horizontal hole for supplying oil is formed extending from the oil passage to the bearing.

6. The scroll fluid machine according to claim 1, further comprising an orbiting plate between an end of the eccentric shaft and the orbiting key, wherein a surface of the orbiting plate at a side of the ring is in contact with a surface of the ring at a side of the orbiting plate.

7. The scroll fluid machine according to claim 6, wherein:

an oil receiving port is formed on an upper surface of the orbiting key;

an oil passage in communication with the oil receiving port is formed inside the eccentric shaft; and a horizontal hole for supplying oil is formed extending from the oil passage to the bearing.

8. The scroll fluid machine according to claim 6, wherein the orbiting plate is brought into partial surface contact with the ring by forming a non-contact portion of at least one of the orbiting plate and the ring into a recess portion.

9. The scroll fluid machine according to claim 8, wherein:

an oil receiving port is formed on an upper surface of the orbiting key;

an oil passage in communication with the oil receiving port is formed inside the eccentric shaft; and a horizontal hole for supplying oil is formed extending from the oil passage to the bearing.

10. The scroll fluid machine according to claim 1, wherein a diamond-like carbon coating is applied to a sliding portion of at least one of the orbiting key, a periphery of the hole, the ring key, and the key groove.

11. The scroll fluid machine according to claim 10, wherein:

an oil receiving port is formed on an upper surface of the orbiting key;

an oil passage in communication with the oil receiving port is formed inside the eccentric shaft; and a horizontal hole for supplying oil is formed extending from the oil passage to the bearing.

12. The scroll fluid machine according to claim 1, wherein:

an oil receiving port is formed on an upper surface of the orbiting key;

an oil passage in communication with the oil receiving port is formed inside the eccentric shaft; and a horizontal hole for supplying oil is formed extending from the oil passage to the bearing.

13. The scroll fluid machine according to claim 1, wherein the length of the long orbiting key is measured along a longest dimension thereof.

* * * * *